US011852438B2

(12) United States Patent
Hedeen, Jr. et al.

(10) Patent No.: US 11,852,438 B2
(45) Date of Patent: Dec. 26, 2023

(54) TOY DART GUNS HAVING FLYWHEEL ASSEMBLIES

(71) Applicant: Hedeen International, LLC, Sturgeon Bay, WI (US)

(72) Inventors: Clemens V. Hedeen, Jr., Sturgeon Bay, WI (US); Kay Lee Hedeen, Sturgeon Bay, WI (US); Matthew P. Davis, Green Bay, WI (US)

(73) Assignee: HEDEEN INTERNATIONAL, LLC, Sturgeon Bay, WI (US)

( * ) Notice: Subject to any disclaimer, the term of this patent is extended or adjusted under 35 U.S.C. 154(b) by 0 days.

(21) Appl. No.: 17/738,400

(22) Filed: May 6, 2022

(65) Prior Publication Data

US 2022/0357125 A1 Nov. 10, 2022

Related U.S. Application Data

(60) Provisional application No. 63/185,755, filed on May 7, 2021.

(51) Int. Cl.
*F41B 4/00* (2006.01)
*F41B 7/08* (2006.01)

(52) U.S. Cl.
CPC ..... *F41B 7/08* (2013.01)

(58) Field of Classification Search
CPC ..... F41B 4/00; F41B 7/08; F41B 11/89
USPC ..... 124/6, 27, 78, 82
See application file for complete search history.

(56) References Cited

U.S. PATENT DOCUMENTS 5,471,967 A * 12/1995 Matsuzaki ..... F41B 4/00 124/78
5,611,321 A * 3/1997 Hoeting ..... F41B 4/00 124/79
5,782,228 A * 7/1998 Wu ..... F41B 4/00 124/6
5,996,564 A * 12/1999 Kotowski ..... F41B 4/00 124/6
6,116,229 A * 9/2000 Wu ..... F41B 4/00 124/6
6,523,535 B2 * 2/2003 Rehkemper ..... F41B 4/00 124/78
6,915,793 B2 * 7/2005 Vanek ..... F41B 4/00 124/78
7,051,727 B2 * 5/2006 Wu ..... F41B 4/00 124/6
8,082,909 B2 * 12/2011 Sopinsky ..... A63F 9/02 124/16
8,955,503 B2 * 2/2015 Corsiglia ..... A63B 69/406 124/78
8,997,727 B1 * 4/2015 Hamel ..... A63H 33/18 124/16

(Continued)

*Primary Examiner* — Alexander R Niconovich
(74) *Attorney, Agent, or Firm* — Dinsmore & Shohl LLP

(57) ABSTRACT

A toy launcher for launching a projectile, the toy launcher includes a housing having a launch opening, a launch mechanism provided within the housing, the launch mechanism including at least one flywheel configured to launch the projectile, a pusher mechanism configured to move the projectile into contact with the at least one flywheel, and a trigger mechanism that, when actuated, is configured to move the projectile with the pusher mechanism into contact with the at least one flywheel and configured to rotate the at least one flywheel to launch the projectile through the launch opening in the housing.

18 Claims, 13 Drawing Sheets

(56) References Cited

U.S. PATENT DOCUMENTS

Figure 1:
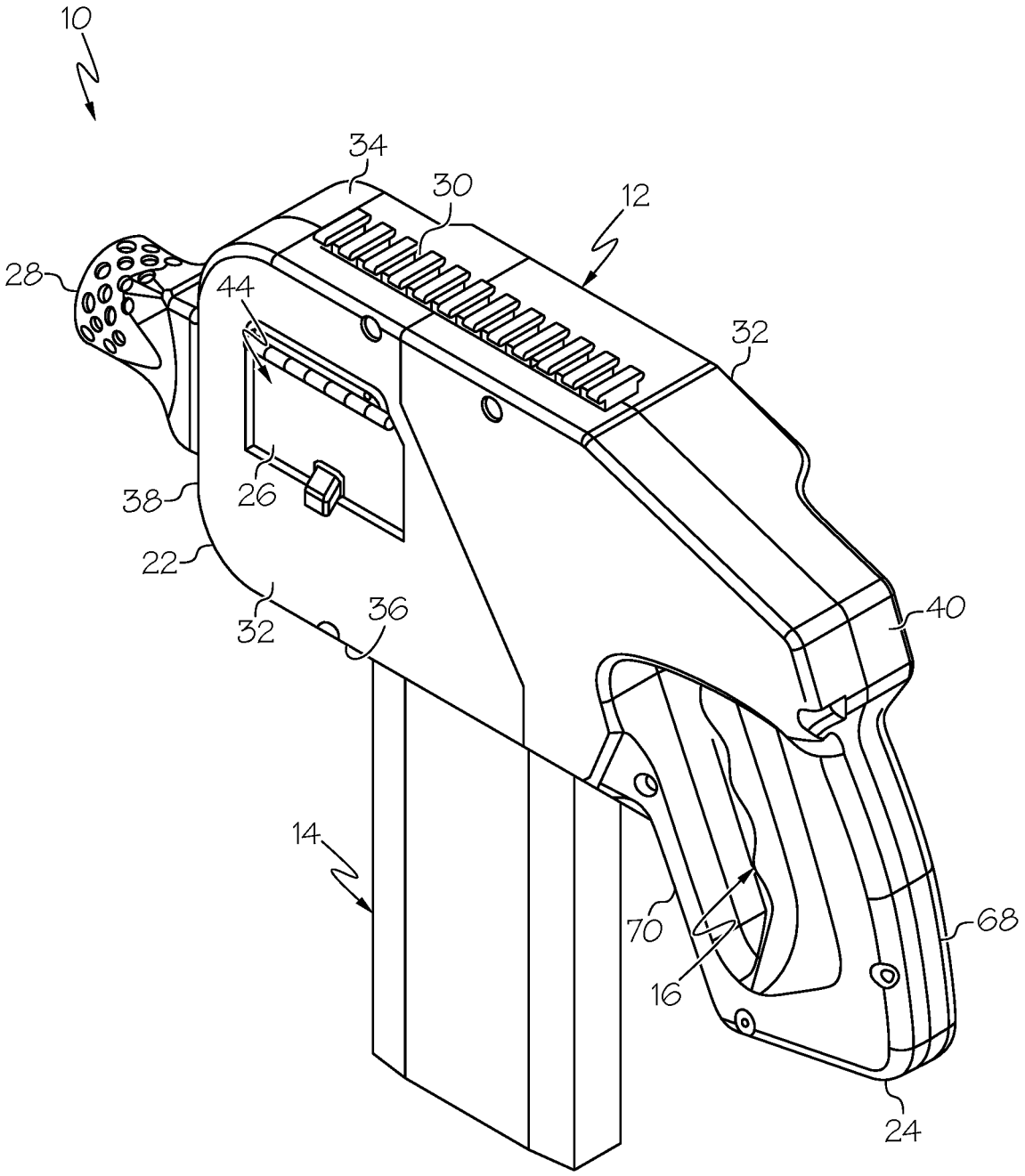

| | | | | |
|---|---|---|---|---|
| 9,027,541 | B2 * | 5/2015 | Huebl | F41B 11/681 124/56 |
| 9,500,432 | B2 * | 11/2016 | Chia | F41B 11/641 |
| 9,958,230 | B1 * | 5/2018 | Nugent | F41A 9/65 |
| 10,533,821 | B2 * | 1/2020 | Chia | F41B 11/54 |
| 10,648,763 | B2 * | 5/2020 | Chia | F41B 11/52 |
| 10,648,767 | B2 * | 5/2020 | Chia | F41B 4/00 |
| 10,859,337 | B1 * | 12/2020 | Bernal | F41B 7/08 |
| 10,876,809 | B1 * | 12/2020 | Kopman | F41B 4/00 |
| 11,340,037 | B1 * | 5/2022 | Chia | F41B 7/08 |
| 2002/0166551 | A1 * | 11/2002 | Lee | F41B 4/00 124/78 |
| 2019/0113305 | A1 * | 4/2019 | Johnson | F41B 11/55 |

* cited by examiner

TOY DART GUNS HAVING FLYWHEEL ASSEMBLIES

CROSS-REFERENCE TO RELATED APPLICATION

This application claims priority to U.S. Provisional Patent Application No. 63/185,755 filed May 7, 2021, for "Toy Dart Guns Having Flywheel Assemblies" which is hereby incorporated by reference in its entirety including the drawings.

TECHNICAL FIELD

The present disclosure is directed to toy guns, more particularly, toy guns having a flywheel assembly.

BACKGROUND

Typically, toy guns having flywheel mechanisms are generally provided with a mechanism for powering the flywheel mechanism that is separate from a trigger. The previously known mechanisms for powering the flywheel mechanism include a motor and batteries or a manual cocking mechanism with a cocking actuator. The cocking actuator, such as a slide, lever, or tab, is actuated to rotate the flywheels. However, as the manual cocking mechanism is separate from the trigger mechanism, a user is required to manually actuate the cocking assembly and then perform a separate action to actuate the trigger of the trigger mechanism to launch the projectile using the flywheels. As such, a user is required to perform two separate actions to launch the projectile with a manual cocking mechanism, or have increased weight and expense due to the motor and batteries.

Accordingly, a need exists for alternative toy guns that do not require an air compression chamber or a cocking mechanism separate from the trigger mechanism.

SUMMARY

In one embodiment, a toy launcher for launching a projectile, the toy launcher includes a housing having a launch opening, a launch mechanism provided within the housing, the launch mechanism including at least one flywheel configured to launch the projectile, a pusher mechanism configured to move the projectile into contact with the at least one flywheel, and a trigger mechanism that, when actuated, is configured to move the projectile with the pusher mechanism into contact with the at least one flywheel and configured to rotate the at least one flywheel to launch the projectile through the launch opening in the housing.

In another embodiment, a toy launcher for launching a projectile, the toy launcher includes a housing having a launch opening, and a launch mechanism provided within the housing. The launch mechanism includes at least one flywheel configured to launch the projectile, a first gear rotatable in a first direction and an opposite second direction, and a one way gear mechanism including a one way gear configured to permit rotation of the first gear to transfer to the at least one flywheel when the first gear rotates in the first direction and to prevent rotation of the first gear to transfer to the at least one flywheel when the first gear rotates in the second direction.

These and additional features provided by the embodiments described herein will be more fully understood in view of the following detailed description, in conjunction with the drawings.

DETAILED DESCRIPTION OF THE DRAWINGS

Figure 2:
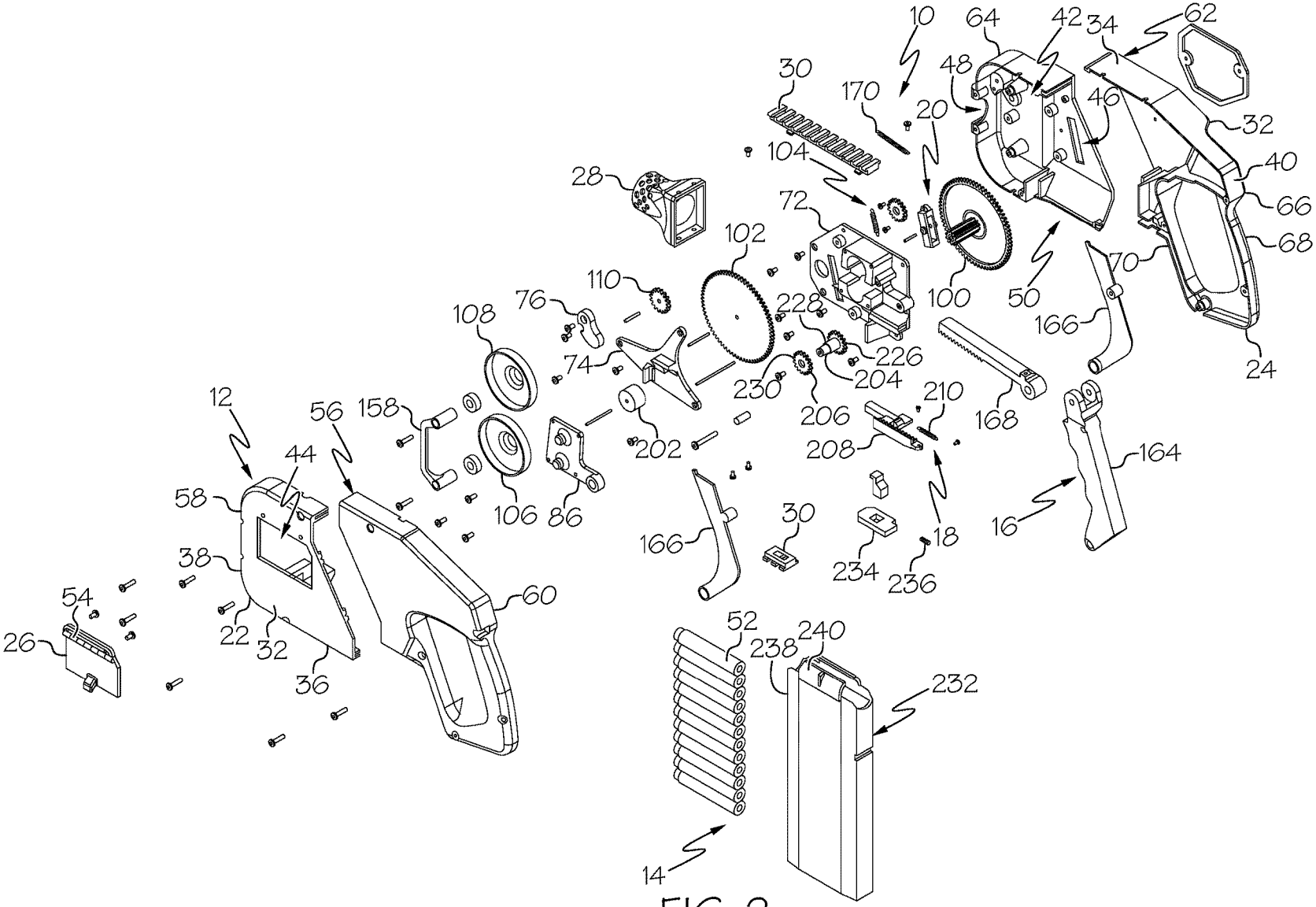
Figure 3:
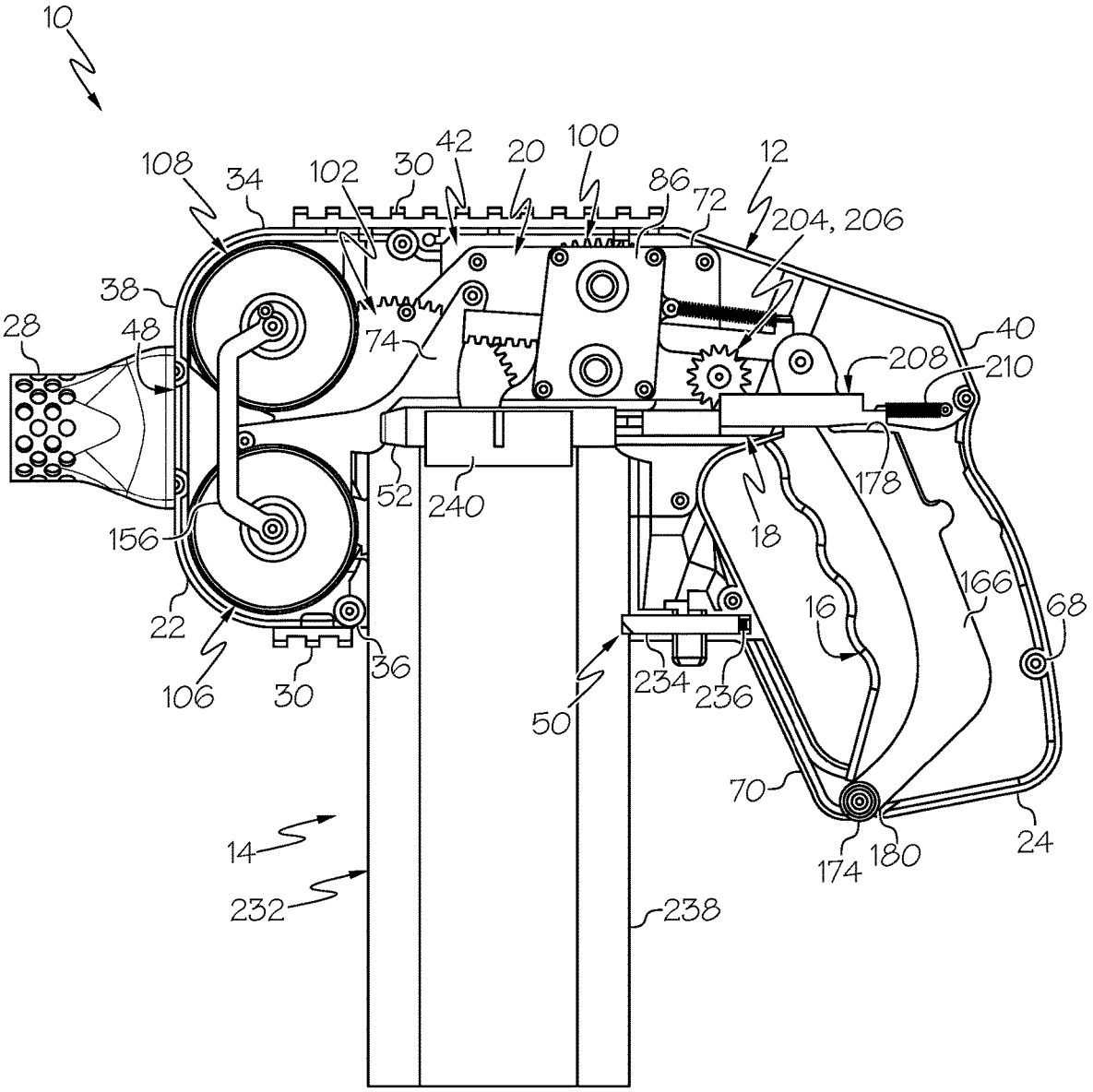
Figure 4:
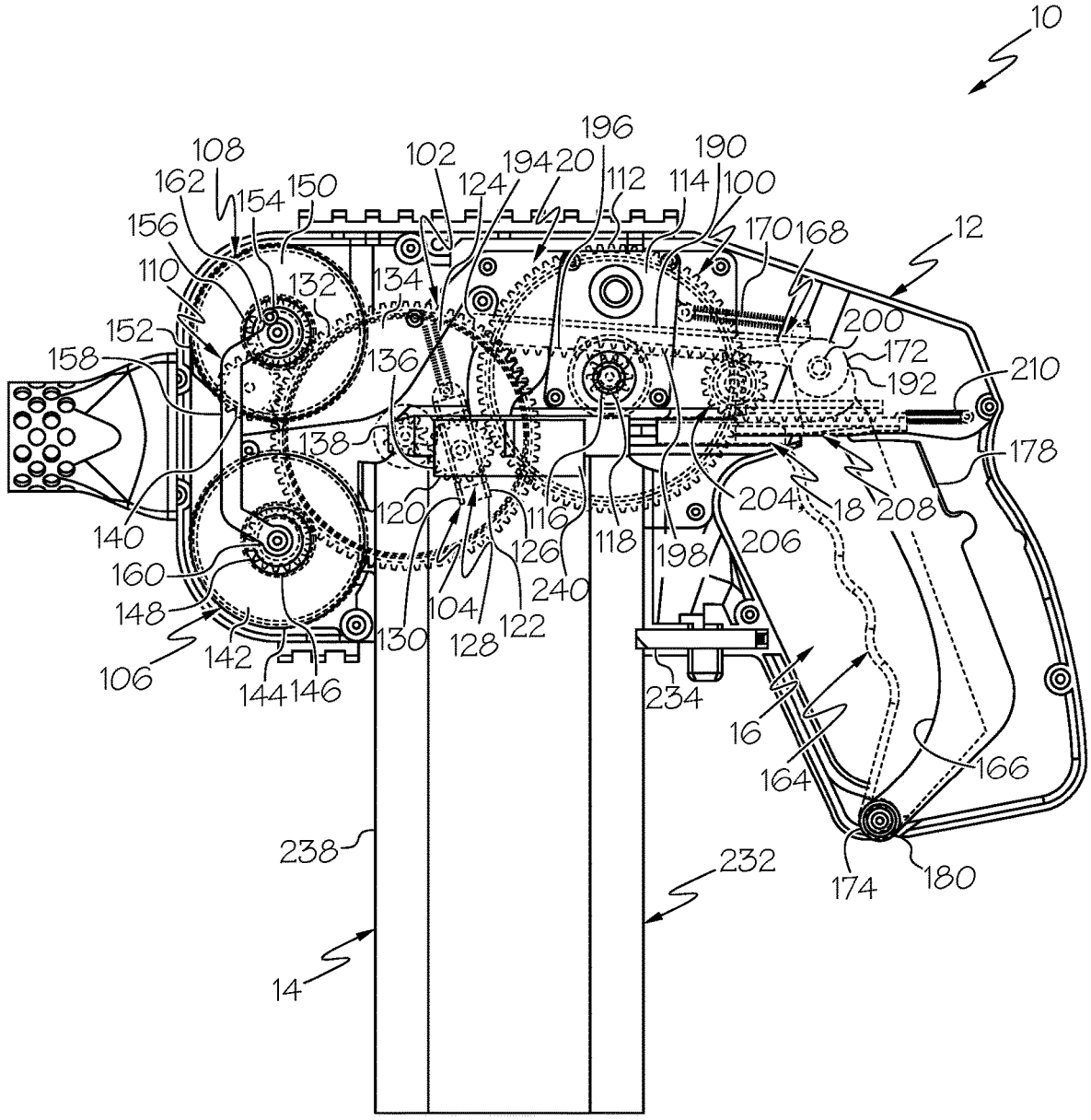
Figure 5:
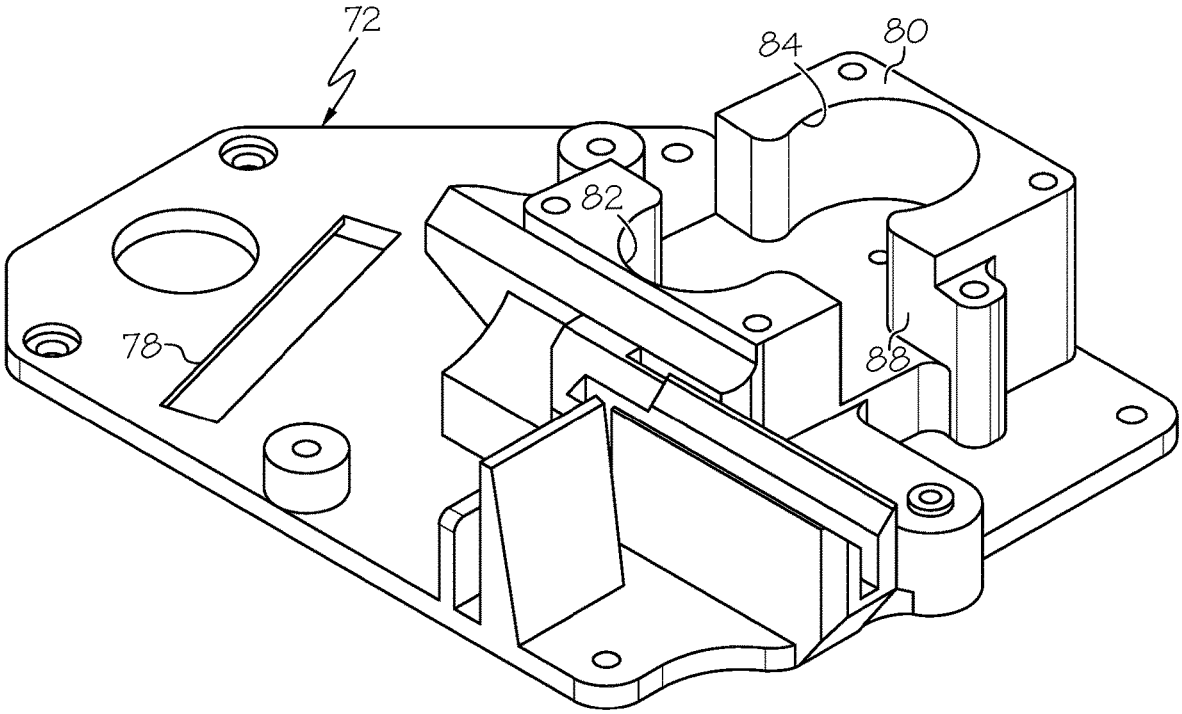
Figure 6:
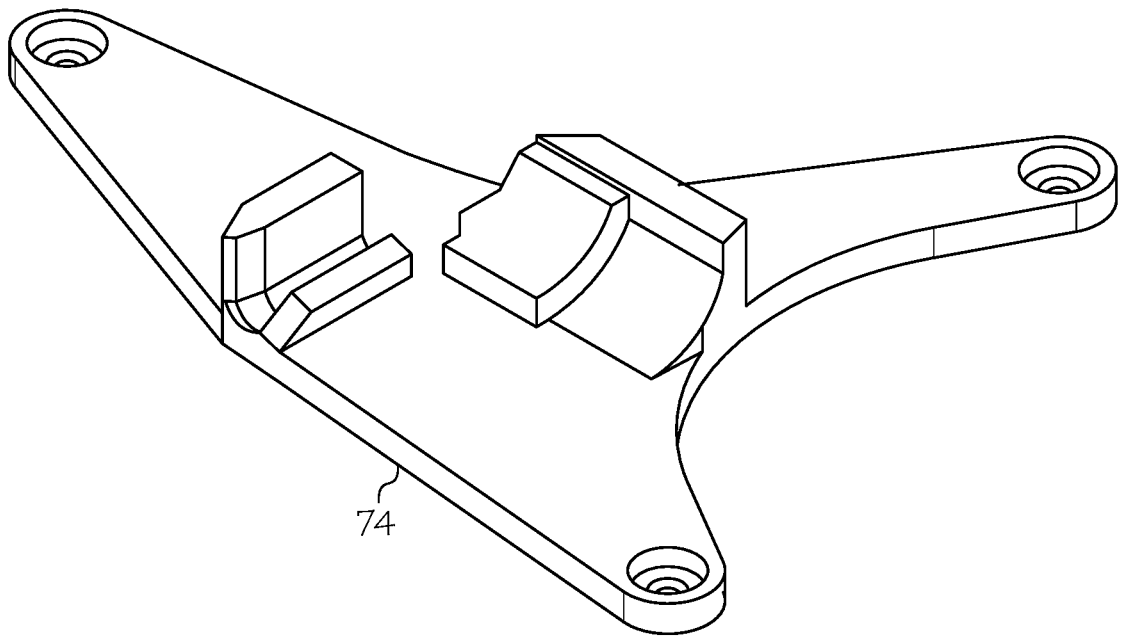
Figure 7:
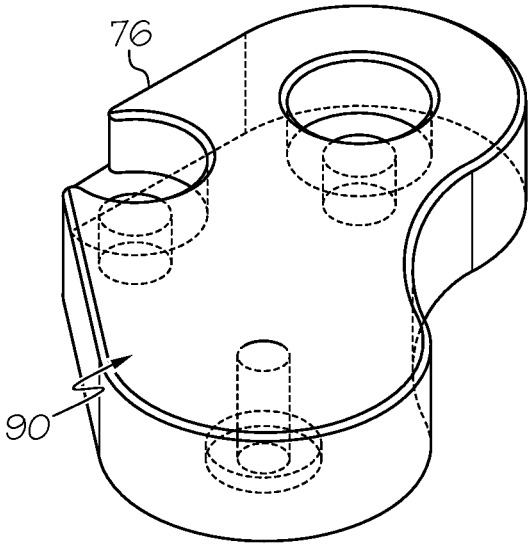
Figure 8:
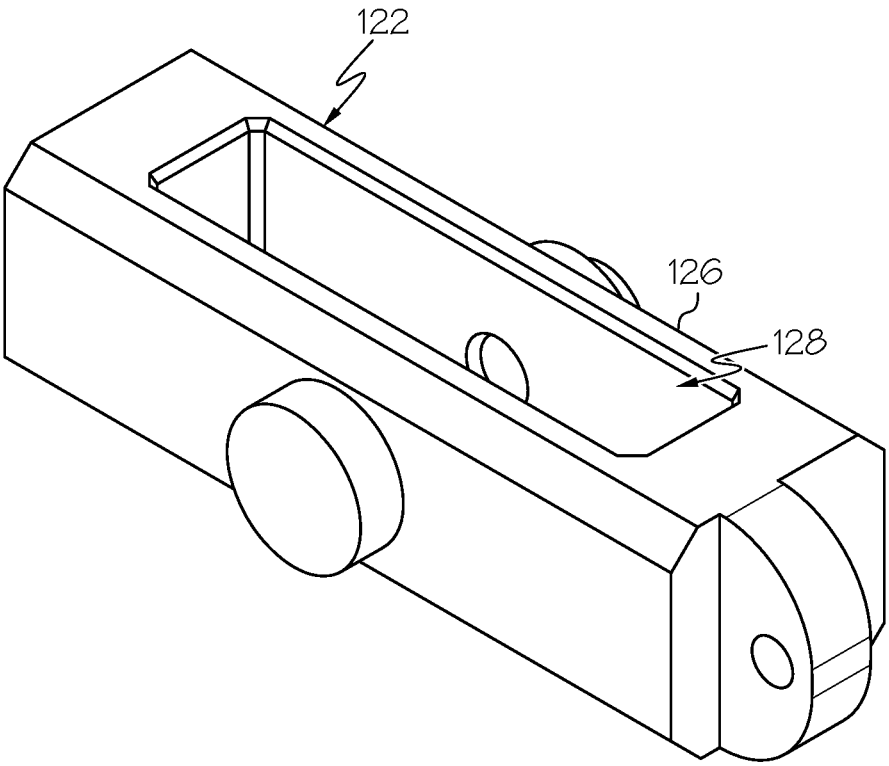
Figure 9:
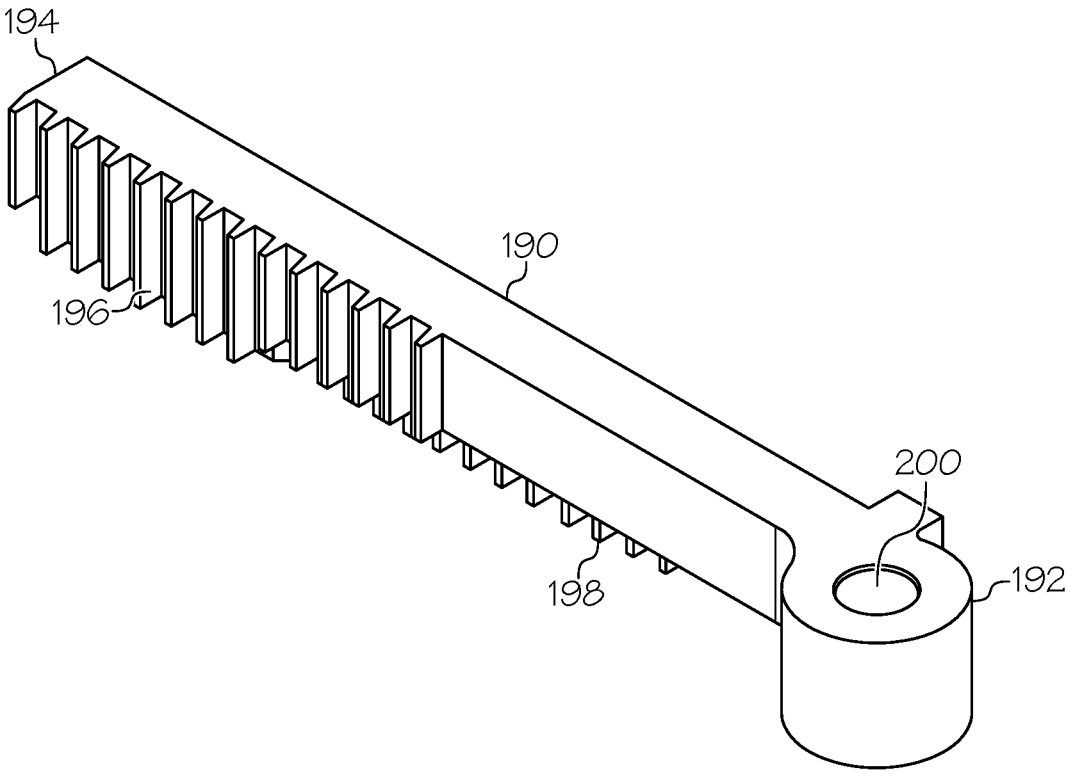
Figure 10:
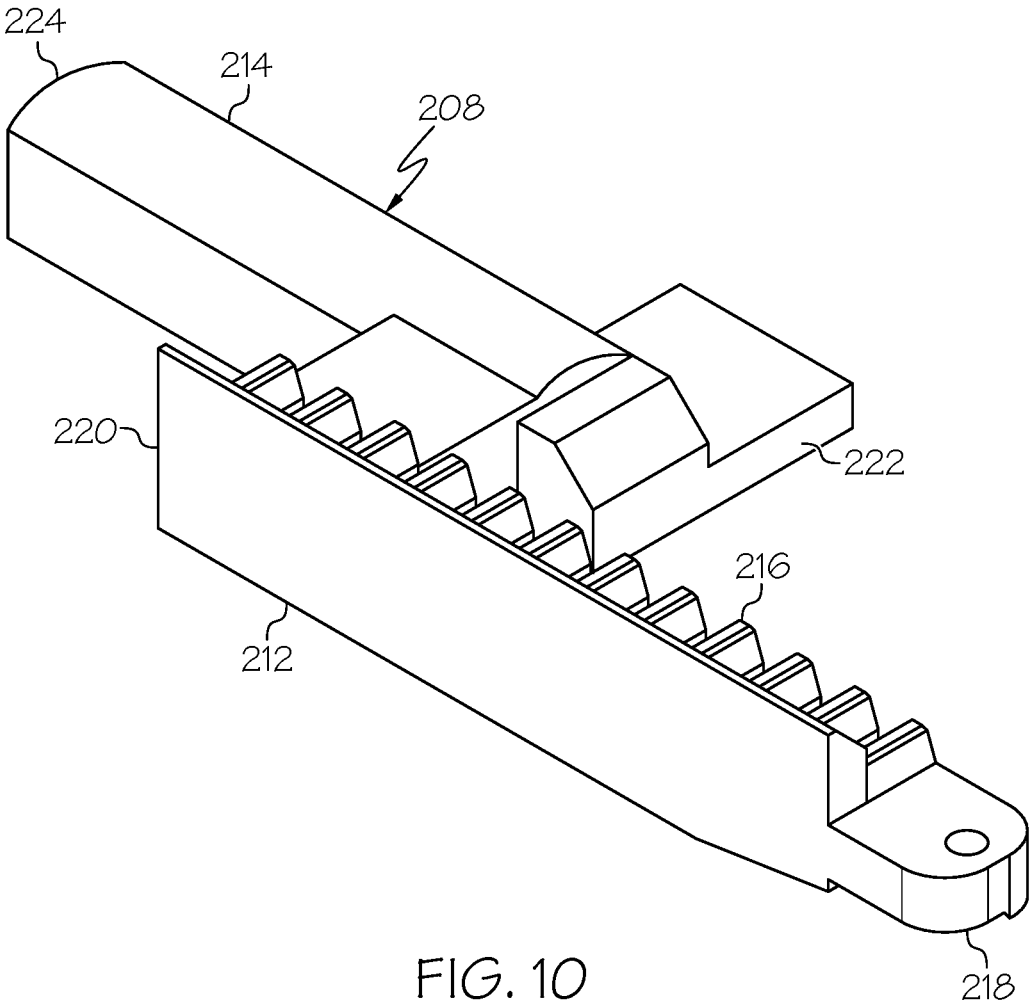
Figure 11:
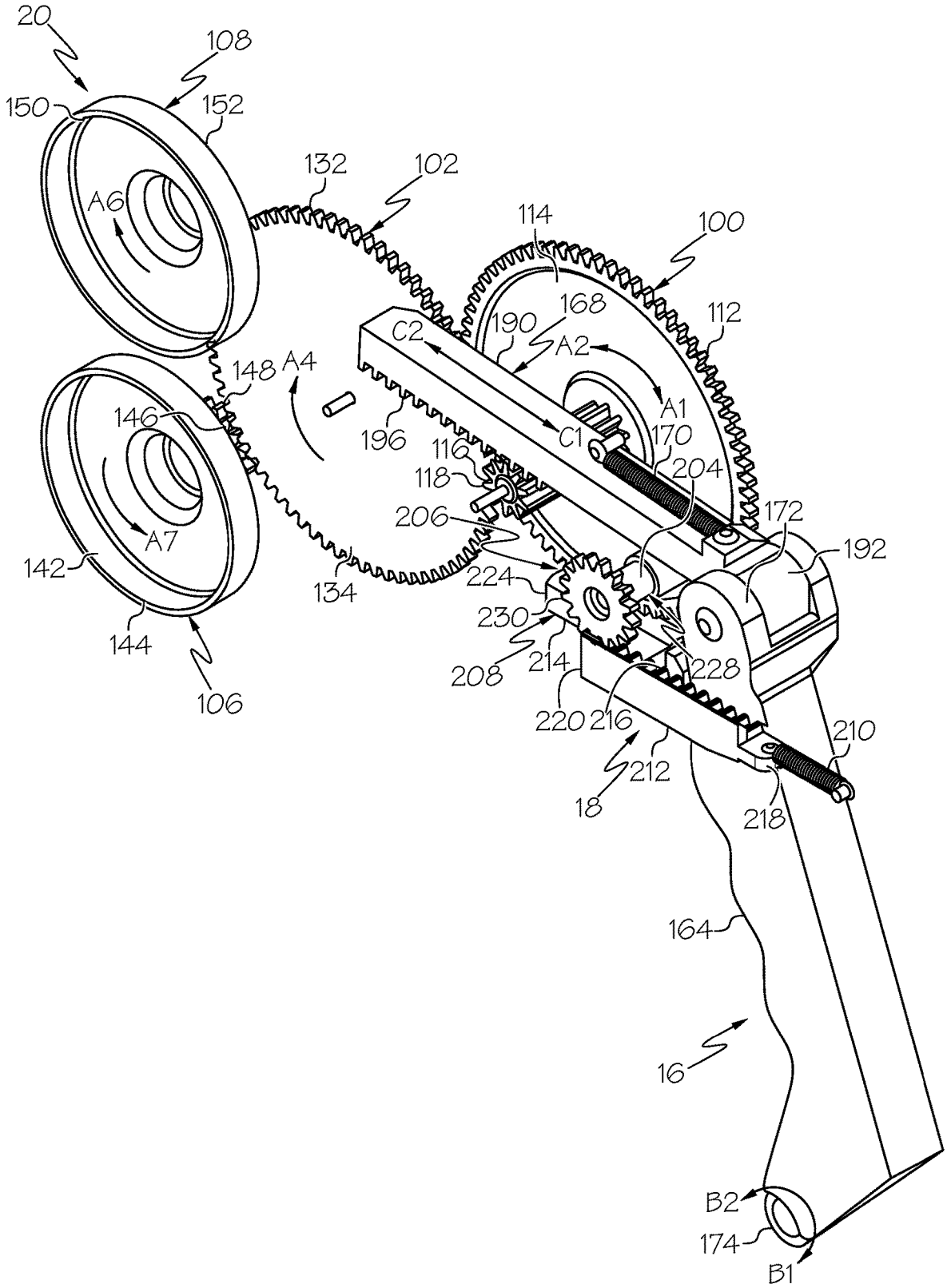
Figure 12:
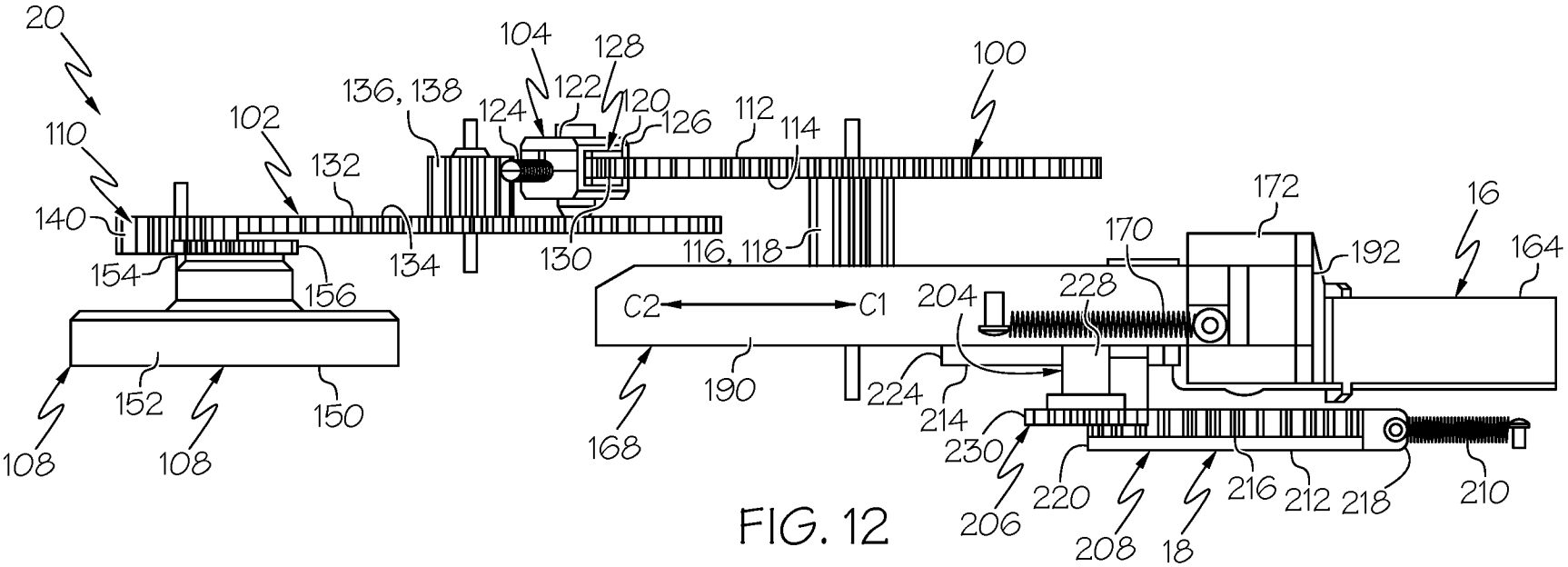
Figure 13:
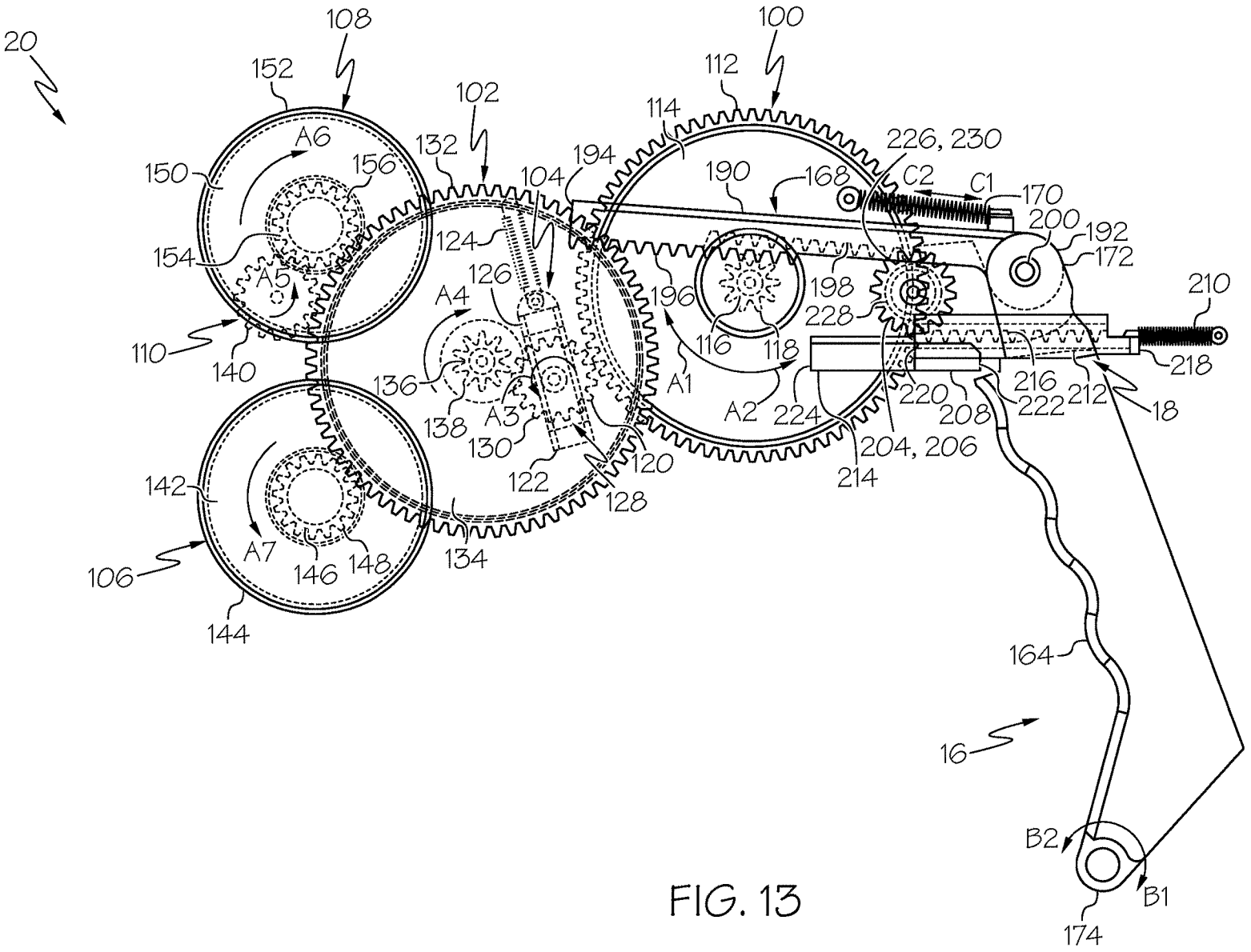

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

FIG. 1 schematically depicts a rear perspective view of a toy gun, according to one or more embodiments shown and described herein;

FIG. 2 schematically depicts an exploded perspective view of the toy gun of FIG. 1, according to one or more embodiments shown and described herein;

FIG. 3 schematically depicts a side view of the toy gun of FIG. 1 with a left shell of a house of the toy gun in phantom, according to one or more embodiments shown and described herein;

FIG. 4 schematically depicts a side view of the toy gun of FIG. 1 with a launch mechanism of the toy gun in phantom, according to one or more embodiments shown and described herein;

FIG. 5 schematically depicts a perspective view of a first gear bracket of the toy gun of FIG. 1, according to one or more embodiments shown and described herein;

FIG. 6 schematically depicts a perspective view of a second gear bracket of the toy gun of FIG. 1, according to one or more embodiments shown and described herein;

FIG. 7 schematically depicts a perspective view of a flywheel reversal gear bracket of the toy gun of FIG. 1, according to one or more embodiments shown and described herein;

FIG. 8 schematically depicts a perspective view of a carriage of the toy gun of FIG. 1, according to one or more embodiments shown and described herein;

FIG. 9 schematically depicts a perspective view of a trigger bar of the toy gun of FIG. 1, according to one or more embodiments shown and described herein;

FIG. 10 schematically depicts a perspective view of a projectile pusher of the toy gun of FIG. 1, according to one or more embodiments shown and described herein;

FIG. 11 schematically depicts a perspective view of the launch mechanism of FIG. 10, according to one or more embodiments shown and described herein;

FIG. 12 schematically depicts a top view of the launch mechanism of FIG. 10, according to one or more embodiments shown and described herein; and FIG. 13 schematically depicts a side view of the launch mechanism of FIG. 10, according to one or more embodiments shown and described herein.

DETAILED DESCRIPTION

Embodiments described herein are directed to a toy gun. The toy gun generally includes a housing assembly, a trigger assembly, a flywheel assembly, and a clip or magazine. Various embodiments of the toy gun and the operation of the toy gun will be described in more detail herein.

Referring now to FIGS. 1-4, a toy gun 10 configured to launch a projectile 52 is illustrated. The toy gun 10 includes a housing assembly 12, a magazine assembly 14, a trigger mechanism 16, a pusher mechanism 18, and a launch mechanism 20. The housing assembly 12 may include a main body 22, a handle 24 extending from the main body 22, an access door 26, a barrel 28, a pair of accessory rails 30, a first gear plate 72, a second gear plate 74, and a flywheel reversal gear bracket 76. The main body 22 may include a pair of side surfaces 32, an upper surface 34, an opposite lower surface 36, a front end 38, and an opposite rear end 40. The pair of side surfaces 32, the upper surface 34, and the lower surface 36 may each extend between the front end 38 and the rear end 40.

The main body 22 may define a cavity 42 enclosed therein, an access opening 44 formed on one of the pair of side surfaces 32, a carriage slot 46 formed in the other of the pair of side surfaces 32, a projectile opening 48 formed at the front end 38, and a magazine opening 50 formed in the lower surface 36. The barrel 28 may fixedly coupled to the front end 38 of the main body 22 and be aligned with the projectile opening 48 to allow a projectile 52 to be launched out of the projectile opening 48 and through the barrel 28. The pair of accessory rails 30 may be fixedly coupled to the upper surface 34 and/or the lower surface 36, and be configured to receive one or more accessories for the toy gun 10. The accessories may be any traditional accessory for a toy gun 10, such as a laser or a scope, and be removably coupled to the accessory rails 30.

The access opening 44 may be positioned along the one of the side surfaces 32 to be configured to allow a user to dislodge a projectile 52 that may be stuck in the cavity 42 of the main body 22. The access door 26 may be positioned on one of the side surfaces 32 of the main body 22 and extend over the access opening 44 to restrict ingress and egress through the access opening 44. The access door 26 may be pivotally coupled to the side surface 114, such as via a hinge 54, to allow the access door 26 to pivot away from the access opening 44, allowing for selective opening of the access opening 44.

The housing 238 may include a multi-shell construction that are formed separately and independently coupled together to define the main body 22 and the handle 24. For example, the multi-shell construction may include a left shell 56 having a front section 58 and a rear section 60, and a right shell 62 having a front section 64 and a rear section 66. However, it is contemplated and possible that the housing 238 includes any number of shells that define the main body 22 and the handle 24, such as a single shell, two shells, or more than two shells. In embodiments where the housing 238 includes a single shell, the housing 238 may be formed as a single, monolithic one piece structure.

The handle 24 may include a rear grip 68 and a fore grip 70 positioned between the rear grip 68 and the main body 22. The fore grip 70 may extend from the lower surface 36 of the main body 22. The rear grip 68 may extend from the rear end 40 of the main body 22 to meet the fore grip 70 at a junction. The fore grip 70 and the rear grip 68 may be formed as a single monolithic one piece structure with the main body 22. The rear grip 68 may be contoured to fit the palm of a user's hand when gripped by the user.

Referring to FIGS. 2-6, each of the first gear plate 72 and the second gear plate 74 may be positioned within the cavity 42 of the housing assembly 12 and coupled to the housing assembly 12. Referring to FIG. 5, the first gear plate 72 may include an elongated slot 78 formed therein, a protrusion 80, a first bore 82 formed therein, a second bore 84 formed therein, and a groove 88 formed therein extending between the first bore 82 and the second bore 84. The elongated slot 78 may be aligned with the slot 46 of the housing assembly 12 so that a component of the launch mechanism 20 may be movable along both the elongated slot 78 and the slot 46, as will be described in further detail herein.

Referring to FIGS. 2 and 3, a first gear top plate 86 is coupled to the first gear plate 72 to enclose the protrusion 80. Referring to FIGS. 2-3 and 6, the second gear plate 74 may be configured to be coupled to a gear of the launch mechanism 20, as will be described in further detail herein, to position that gear within the housing assembly 12 relative to other gears in the launch mechanism 20. Referring to FIGS. 3 and 7, the flywheel reversal gear bracket 76 may include a cavity 90 configured to receive a gear, as will be described in further detail herein. The flywheel reversal gear bracket 76 may be secured to the housing assembly 12.

Referring now to FIGS. 2-4, the launch mechanism 20 may include a first gear 100, a second gear 102, a one way gear mechanism 104, a first flywheel 106, a second flywheel 108, and a flywheel reversal gear 110. The launch mechanism 20 may be positioned in the cavity 42 of the housing assembly 12, and be operatively connected to the trigger mechanism 16 to launch the projectile 52 when the trigger mechanism 16 is actuated.

The first gear 100 may be rotatably coupled to the first gear plate 72 to be rotatable in a first direction and an opposite second direction. When the first gear 100 rotates in the first direction, the first gear 100 may rotate in the direction of arrow A1, as shown in FIG. 13. When the first gear 100 rotates in the second direction, the first gear 100 may rotate in the direction of arrow A2. The first gear 100 may include a large radial set of teeth 112, a side surface 114, and a toothed shaft 116 extending from the side surface 114. The toothed shaft 116 may include a small radial set of teeth 118 that has a smaller radius than the large radial set of teeth 112. The toothed shaft 116 of the first gear 100 may be positioned to extend through the first bore 82 of the first gear plate 72. The small radial set of teeth 112 may be engaged, or in contact, with the trigger bar 168 so that movement of the trigger bar 168 causes the first gear 100 to rotate, as will be described in further detail herein. The large radial set of teeth 112 of the first gear 100 may be configured to be engaged or in contact with the one way gear mechanism 104 to transfer movement from the trigger bar 168 to the one way gear mechanism 104. The small radial set of teeth 112 may include ten teeth 112 and the large radial set of teeth 112 may include seventy teeth, however, the amount of teeth 112 of each of the small radial set of teeth 112 and the large radial set of teeth 112 may be increased or decreased to increase or decrease the gear ratio of the first gear 100.

The one way gear mechanism 104 may include a one way gear 120, a carriage 122, and a carriage biasing member 124. Referring briefly to FIG. 8, the carriage 122 may include a hollow body 126 defining a cavity 128 therein. Referring back to FIGS. 2-4, the carriage 122 may be slidably received within the elongated slot 78 of the first gear plate 72 and the slot 46 in the housing assembly 12 such that the carriage 122 is moveable along the elongated slot 78 and the slot 46 between an engaged position and a disengaged position. The biasing member 124 may extend between the carriage 122 and the first gear plate 72 and be coupled to each of the carriage 122 and the first gear plate 72. The biasing member 124 may bias the carriage 122 toward the engaged position.

The one way gear 120 may be positioned within the cavity 128 of the carriage 122 and be rotatably coupled to the carriage 122 to rotate in the direction of arrow A3. The one way gear 120 may include a set of teeth 130 that extend from the carriage 122 to contact and be engaged with both the first gear 100 and the second gear 102 when the carriage 122 is in the engaged position. The one way gear 120 may be configured to transfer rotation from the first gear 100 to the second gear 102 when the first gear 100 rotates in the first direction and prevents transfer of rotation from the first gear 100 to the second gear 102 when the first gear 100 rotates in the second direction. When the first gear 100 rotates in the second direction, the contact between the large set of teeth 112 of the first gear 100 and the set of teeth 130 of the one way gear 120 moves the carriage 122 from the engaged position to the disengaged position. In the disengaged position, the set of teeth 130 of the one way gear 120 are spaced apart from the second gear 102 to be disengaged with the second gear 102. In the disengaged position, the biasing member 124 is extended to bias the carriage 122 toward the engaged position. In other words, in the disengaged position, a length of the biasing member 124 is greater than the length of the biasing member 124 in the engaged position.

The second gear 102 may be rotatably coupled to the second gear plate 74 to be rotatable in a direction of arrow A4. The second gear 102 may include a large radial set of teeth 132, a side surface 134, and a toothed shaft 136 extending from the side surface 114. The toothed shaft 136 may include a small radial set of teeth 138 that has a smaller radius than the large radial set of teeth 132. The toothed shaft 136 of the second gear 102 may be positioned to be engaged, or in contact, with the set of teeth 130 of the one way gear 120 when the one way gear 120 is in the engaged position so that rotation of the one way gear 120 causes the second gear 102 to rotate. The large radial set of teeth 132 of the second gear 102 may be configured to be engaged or in contact with the first flywheel 106 and the flywheel reversal gear 110 to transfer rotation from the second gear 102 to the first flywheel 106 and the second flywheel 108. As depicted in FIG. 10, the small radial set of teeth 138 may include ten teeth and the large radial set of teeth 132 may include seventy teeth, however, the amount of teeth of each of the small radial set of teeth 138 and the large radial set of teeth 132 may be increased or decreased to increase or decrease the gear ratio of the second gear 102.

Referring to FIGS. 2-4 and 11-13 the flywheel reversal gear 110 may include a set of teeth 140 that is in contact and engaged with the large set of teeth 132 of the second gear 102 to rotate with the second gear 102. The flywheel reversal gear 110 may be rotatably coupled to the flywheel reversal gear bracket 76 to rotate in the direction of arrow A5.

The first flywheel 106 may include a cylindrical body 142, a rim 144, and a toothed shaft 146 extending from the cylindrical body 142 and having a set of teeth 148. The set of teeth 148 may be in contact and engaged with the set of teeth 132 of the second gear 102 such that rotation of the second gear 102 causes the first flywheel 106 to rotate in the direction of arrow A7. The second flywheel 108 may similarly include a cylindrical body 150, a rim 152, and a toothed shaft 154 extending from the cylindrical body 142 and having a set of teeth 156. The set of teeth 156 of the second flywheel 108 may be in contact and engaged with the flywheel reversal gear 110 such that rotation of the flywheel reversal gear 110 causes the second flywheel 108 to rotate in the direction of arrow A6. Each of the set of teeth 148 of the first flywheel 106 and set of teeth 156 of the second flywheel 108 may include sixteen teeth, however, the amount of teeth may be increased or decreased depending on the desired rotational speed of each of the first flywheel 106 and the second flywheel 108. Additionally, it is contemplated and possible for the first flywheel 106 and the second flywheel 108 to include a different number of teeth so that each flywheel rotates at a different speed.

A flywheel connecting rod 158 may include a first end 160 rotatably coupled to the first flywheel 106 and an opposite second end 162 rotatably coupled to the second flywheel 108 to allow each of the first flywheel 106 and the second flywheel 108 to rotate. The flywheel connecting rod 158 may maintain a predetermined distance of separation between the rim 144 of the first flywheel 106 and the rim 152 of the second flywheel 108. The predetermined distance may be equal to or less than a thickness of the projectile 52 so that the first flywheel 106 and the second flywheel 108 may accelerate the projectile 52 when the projectile 52 passes between the first flywheel 106 and the second flywheel 108.

Referring still to FIGS. 2-4 and 11-13, the trigger mechanism 16 may include a trigger 164, a pair of trigger side shields 166, a trigger bar 168, and a trigger return spring 170. The trigger 164 may be an elongated body having a first end 172 and an opposite second end 174. The second end 174 may be pivotally coupled to the handle 24 of the housing assembly 12 at the junction between the fore grip 70 and the rear grip 68 to allow the trigger 164 to be pivotable in the directions of arrow B1 and B2 between a safety position and a firing position. The trigger 164 may pivot in the direction of arrow B1 when moving from the safety position to the firing position, and pivot in the direction of arrow B2 when moving from the firing position to the safety position. The trigger 164 may be contoured to the shape of a user's hand when gripping the trigger 164.

Each of the pair of trigger side shields 166 may be an elongated body having a first end 178 and an opposite second end 180. When assembled, the pair of trigger side shields 166 are positioned to flank the trigger 164 on opposing sides and may be coupled together. The second end 180 of each of the trigger side shields 166 may be pivotally coupled to the second end 174 of the trigger 164 so that the trigger side shields 166 may be independently pivotable relative to the trigger 164.

Referring now to FIGS. 2-4, 9 and 11-13, the trigger bar 168 may include an elongated body 190 having a first end 192 and an opposite second end 194, a first set of teeth 196, a second set of teeth 198, and an aperture 200. The first set of teeth 196 and the second set of teeth 198 may extend in parallel along the elongated body 190 between the first end 192 and the second end 194. The aperture 200 may be positioned between the first end 192 of the elongated body 190 and each of the first set of teeth 196 and the second set of teeth 198. The second end 194 of the trigger bar 168 may be pivotally coupled to the first end 172 of the trigger 164 and be positioned within the cavity 42 of the housing assembly 12 so that the first set of teeth 196 of the trigger bar 168 engages the small radial set of teeth 118 of the first gear 100. The trigger return spring 170 may extend between and be coupled to the aperture 200 of the trigger bar 168 and the first gear plate 72. When the trigger 164 moves from the safety position to the firing position, the pivoting of the trigger 164 moves the trigger bar 168 in the direction of arrow C1 along the small radial set of teeth 118 of the first gear 100 to rotate the first gear 100 in the first direction. When the trigger 164 is in the firing position, the trigger return spring 170 biases the trigger bar 168 in the direction of arrow C2 and the trigger 164 toward the safety position.

The trigger bar 168 may extend through the groove 88 of the first gear plate 72 to engage the small radial set of teeth 118 of the first gear 100. The trigger mechanism 16 may include a roller 202 positioned and pivotally coupled to the second bore 84 of the first gear plate 72. The roller 202 may be in contact with the trigger bar 168 to guide the trigger bar 168 along the groove 88 of the first gear plate 72.

Referring now to FIGS. 2-4 and 10-13, the pusher mechanism 18 may include a pusher gear shaft 204, a pusher gear 206, a pusher 208, and a pusher return spring 210. The pusher 208 may include a first portion 212 and a second portion 214 fixedly coupled to and axially offset from the first portion 212, and a set of teeth 216 extending along the first portion 212. The first portion 212 may include a first end 218 and an opposite second end 220 that is coupled to the second portion 214. The second portion 214 may include a coupling end 222 coupled to the first portion 212 and a contact end 224 opposite the coupling end 222. The pusher return spring 210 may be positioned between and coupled to the housing assembly 12 and the first end 218 of the first portion 212 of the pusher 208.

The pusher gear shaft 204 may include a set of teeth 226 and a shaft 228 extending from the set of teeth 226. The set of teeth 226 of the pusher gear shaft 204 may be engaged with the second set of teeth 198 on the trigger bar 168 so that movement of the trigger bar 168 rotates the pusher gear shaft 204. The pusher gear 206 may be fixedly coupled to the shaft 228 of the pusher gear shaft 204 to rotate with the pusher gear shaft 204. The pusher gear 206 may include a set of teeth 230 that are engaged with the set of teeth 216 of the pusher 208 to move the pusher 208 between an engaged position and a disengaged position. The pusher return spring 210 may bias the pusher 208 from the engaged position toward the disengaged position. In the disengaged position, the pusher 208 may be spaced apart from the projectile 52 with the biasing member 210 compressed. In the engaged position, the pusher 208 contacts the projectile 52 to move the projectile toward the flywheels 106, 108, with the biasing member 210 being extended to have a length that is greater than the length of the biasing member 210 in the disengaged position. When moving from the disengaged position to the engaged position, the pusher 208 contacts the projectile 52 to move the projectile 52 toward the first flywheel 106 and the second flywheel 108.

Between the safety position and the firing position, the trigger 164 may rotate to a half-pull position. In the half-pull position, the projectile 52 pusher 208 may be in the disengaged position. The rotation of the trigger 164 from the safety position to the half-pull position activates the flywheel assembly to rotate the second flywheel 108 and the first flywheel 106. When the trigger 164 is rotated from the safety position to the half-pull position, the pusher gear 206 may rotate, thereby moving the pusher 208. The movement of the projectile 52 pusher 208 may be less than a distance required to move the projectile 52 between the second flywheel 108 and the first flywheel 106.

Referring again to FIGS. 2-4, the magazine assembly 14 may include a magazine 232 and a release 234 configured to engage the magazine 232 to selectively couple the magazine 232 to the housing assembly 12. The release 234 may be slidably coupled to the housing 238 and include a biasing member 236 that biases the release 234 to engage the magazine 232 when the magazine 232 is inserted into the housing assembly 12 through the magazine opening 50.

The magazine 232 may be a traditional magazine 232 configured to maintain a plurality of projectiles. The magazine 232 may include a housing 238, a set of projections 240 extending from the housing 238, and a biasing member 236 (not shown) configured to bias projectiles 52 positioned within the housing 238 into contact with the projections 240. The projections 240 may extend from the housing 238 to allow the second portion 214 of the pusher 208 to extend between the projections 240 and the housing assembly 12 to contact the projectiles 52. When inserted into the toy gun 10, the magazine 232 is partially positioned within the housing assembly 12 so that the projectile 52 in the magazine 232 is positioned between the pusher 208 and the flywheels 106, 108. When the magazine 232 is inserted into the toy gun 10, the release 234 engages the magazine 232 to maintain the magazine 232 partially positioned within the housing assembly 12. The release 234 may be moved out of contact with the magazine 232 to release the magazine 232 from the housing assembly 12.

Operation of the toy gun 10 will now be described with reference to the above disclosure. Referring to FIGS. 4 and 11-13, when the trigger 164 moves from the safety position to the firing position, the trigger 164 rotates about the second end 174 of the trigger 164 in the direction of arrow B1 to move the trigger bar 168 in the direction of arrow C1. The rotation of the trigger 164 rotates the side shields 166 with the trigger 164.

When the trigger bar 168 moves in the direction of arrow C1, the engagement between the first set of teeth 196 of the trigger bar 168 and the small radial set of teeth 118 of the first gear 100 rotates the first gear 100 in the direction of arrow A1. Further, the engagement between the second set of teeth 198 of the trigger bar 168 and the set of teeth 216 of the pusher gear shaft 204 rotates the pusher gear shaft 204 and the pusher gear 206. The rotation of the first gear 100 in the first direction, that is the direction of arrow A1, rotates the one way gear 120 in the direction of arrow A3, which further transfers rotation to rotate the second gear 102 in the direction of arrow A4, the flywheel reversal gear 110 in the direction of arrow A5, the first flywheel 106 in the direction of arrow A7, and the second flywheel 108 in the direction of arrow A6 so that the flywheels 106, 108 are configured to launch the projectile 52. As the flywheels 106, 108 are rotating, rotation of the pusher gear 206 moves the pusher 208 to the engaged position to contact one of the projectiles 52 positioned against the projections 240 of the magazine 232 to advance the projectile 52 to a position between the first flywheel 106 and the second flywheel 108. When the projectile 52 is positioned between the rotating flywheels 106, 108, the projectile 52 contacts each of the rotating flywheels 106, 108 to be accelerated out of the projectile opening 48 and the barrel 28 of the housing assembly 12.

When the trigger 164 is released, the trigger return spring 170 may bias the trigger 164 in the direction of arrow B2 toward the safety position. As the trigger 164 moves back to the safety position, the trigger bar 168 moves across the small radial set of teeth 118 of the first gear 100 and the set of teeth 226 of the pusher gear shaft 204 in the direction of arrow C2 to rotate each of the first gear 100 and the pusher gear shaft 204 in the opposite direction. Particularly, the trigger bar 168 rotates the first gear 100 in the second direction, that is, the direction of arrow A2. As the first gear 100 rotates in the second direction, the contact with the one way gear 120 moves the carriage 122 along the elongated slot 78 to the disengaged position to position the one way gear 120 out of engagement with the second gear 102. The one way gear 120 thereby prevents transfer of rotation from the first gear 100 in the second direction, that is, the direction of arrow A2, to the second gear 102. The first flywheel 106 and the second flywheel 108 may then continue to rotate in the directions of arrow A7 and arrow A6, respectively, as the trigger 164 moves to the safety position. The movement of the trigger bar 168 in the direction of arrow C2 may rotate the pusher gear shaft 204 to retract the pusher 208 away from the magazine 232 to the disengaged position. As the pusher gear shaft 204 retracts, the magazine 232 may bias another projectile 52 into contact with the projections 240.

A user may rotate the second flywheel 108 and the first flywheel 106 without launching a projectile 52 by moving the trigger 164 from the safety position to the half-pull position. The trigger 164 may be moved from the safety position to the half-pull position repeatedly without moving to the firing position to accelerate the first flywheel 106 and the second flywheel 108. Once the flywheels 106, 108 are rotating, the trigger 164 may be rotated to the firing position to move the projectile 52 into position between the first flywheel 106 and the second flywheel 108. During operation of the toy gun 10, the access door 26 may be opened to manually remove a projectile 52 that is stuck between the second flywheel 108 and the first flywheel 106, or otherwise jammed within the housing assembly 12. When the magazine 232 is empty, the release 234 may be actuated to allow the magazine 232 to be removed or replaced.

In some embodiments, the toy gun 10 does not include a magazine 232, where the projectiles may be manually loaded into the toy gun 10. In embodiments, the flywheel assembly may include an alternative orientation such that, for example, the second flywheel 108 and the first flywheel 106 may be positioned horizontally adjacent to one another. In embodiments, the side shields may rotate independently of the trigger 164 such that the side shields may control the pusher 208 and the trigger 164 may control the flywheels.

The above-described disclosure relates to a single-shot toy gun. The toy gun allows for a toy projectile to be fired with a single action, and without the use of compressed air. By replacing a compressed air mechanism with flywheels, the toy gun may fire toy projectiles with less noise, and may increase the effective speed of the toy projectile being fired from the toy gun. The single-shot mechanism increases the speed at which toy projectiles may be fired from the toy gun by eliminating the extra step of cocking an air compression mechanism. This is accomplished by connecting the trigger to both the toy projectile-firing action and the mechanism for launching the toy projectile.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A toy launcher for launching a projectile, the toy launcher comprising:

a housing having a launch opening;

a launch mechanism provided within the housing, the launch mechanism comprising at least one flywheel configured to launch the projectile;

a pusher mechanism configured to move the projectile into contact with the at least one flywheel; and a trigger mechanism that, when actuated, is configured to move the projectile with the pusher mechanism into contact with the at least one flywheel and configured to rotate the at least one flywheel to launch the projectile through the launch opening in the housing, wherein the trigger mechanism comprises:

a trigger rotatably coupled to the housing to be movable between a safety position and a firing position; and a trigger bar coupled to the trigger, the trigger bar including a first set of teeth and a second set of teeth;

wherein the launch mechanism further comprises a first gear rotatably coupled to the housing, the first gear engaged with the first set of teeth of the trigger bar;

the pusher mechanism comprises:

a pusher gear engaged with the second set of teeth of the trigger bar; and a pusher engaged with the pusher gear, wherein when the trigger moves from the safety position to the firing position, the trigger moves the trigger bar, and the movement of the trigger bar rotates the first gear via engagement between the first set of teeth of the trigger bar and the first gear and rotates the pusher gear via engagement between the second set of teeth of the trigger bar and the pusher gear, and in the firing position, the projectile is moved via the pusher into contact with the at least one flywheel.

2. The toy launcher of claim 1, wherein the launch mechanism further comprises:

a second gear engaged with the at least one flywheel; and a one way gear mechanism comprising a one way gear configured to transfer rotation from the first gear to the second gear when the first gear rotates in a first direction and prevents transfer of rotation from the first gear to the second gear when the first gear rotates in a second direction opposite to the first direction.

3. The toy launcher of claim 2, wherein the one way gear mechanism further comprises:

a carriage movably coupled to the housing; and a spring coupling the carriage to the housing, wherein the one way gear is rotatably coupled to the carriage, and the spring biases the one way gear into contact with the first gear and the second gear to transfer rotation from the first gear to the second gear, and when the first gear rotates in the second direction, the one way gear is moved out of contact with the second gear to prevent transfer of rotation from the first gear to the second gear.

4. The toy launcher of claim 3, wherein:

the housing further comprises a slot formed therein, and the carriage is slidably coupled to the slot in the housing to move along a length of the slot.

5. The toy launcher of claim 3, wherein:

the at least one flywheel comprises a first flywheel and a second flywheel;

the first flywheel is engaged with the second gear to rotate with the rotation of the second gear; and the launch mechanism further comprises a flywheel reversal gear engaged with the second gear and the second flywheel to transfer rotation from the second gear to the second flywheel and rotate the second flywheel in a direction opposite to the rotation of the first flywheel.

6. The toy launcher of claim 5, further comprising a flywheel connecting rod that includes a first end and an opposite second end, the first end being rotatably coupled to the first flywheel and the second end being rotatably coupled to the second flywheel, wherein the flywheel connecting rod maintains a predetermined distance of separation between the first flywheel and the second flywheel.

7. The toy launcher of claim 2, wherein:

the first gear has a small radial set of teeth and a large radial set of teeth, the large radial set of teeth being engaged with the one way gear; and the pusher gear has a set of teeth, wherein the first set of teeth of the trigger bar is engaged with the small radial set of teeth of the first gear, and the second set of teeth of the trigger bar is engaged with the set of teeth of the pusher gear.

8. The toy launcher of claim 1, wherein the trigger mechanism further comprises:

a pair of side shields positioned on opposing sides of the trigger, the pair of side shields being pivotally coupled to the trigger.

9. The toy launcher of claim 1, wherein:

the housing further comprises a first gear plate including a protrusion, a bore formed in the protrusion, and a groove extending along the protrusion, the trigger mechanism further comprises a roller positioned in the bore of the first gear plate, and the trigger bar extends into the groove to contact and be movable along the roller.

10. The toy launcher of claim 1, further comprising a magazine removably coupled to the housing, the magazine configured to house at least one projectile, wherein the pusher contacts the at least one projectile in the magazine and moves the at least one projectile into contact with the at least one flywheel when the trigger mechanism is actuated.

11. The toy launcher of claim 1, wherein the housing further comprises an access opening and an access door positioned over the access opening that is movable to allow access to the launch mechanism through the access opening.

12. A toy launcher for launching a projectile, the toy launcher comprising:

a housing having a launch opening;

a launch mechanism provided within the housing, the launch mechanism comprising:

at least one flywheel configured to launch the projectile;

a first gear rotatable in a first direction and an opposite second direction; and a one way gear mechanism comprising a one way gear, a carriage movably coupled to the housing, and a spring coupling the carriage to the housing, the one way gear being configured to permit rotation of the first gear to transfer to the at least one flywheel when the first gear rotates in the first direction and to prevent rotation of the first gear to transfer to the at least one flywheel when the first gear rotates in the second direction; and a trigger mechanism including:

a trigger rotatably coupled to the housing to be movable between a safety position and a firing position; and a trigger bar coupled to the trigger, the trigger bar including a first set of teeth engaged with the first gear, wherein when the trigger moves from the safety position to the firing position, an engagement between the first set of teeth of the trigger bar and the first gear rotates the first gear in the first direction, and wherein when the trigger moves from the firing position to the safety position, the engagement between the first set of teeth of the trigger bar and the first gear rotates the first gear in the second direction.

13. The toy launcher of claim 12, wherein the launch mechanism further comprises a second gear engaged with the one way gear and the at least one flywheel, wherein:

the one way gear is rotatably coupled to the carriage, and the spring biases the one way gear into contact with the first gear and the second gear to transfer rotation from the first gear to the second gear, and when the first gear rotates in the second direction, the one way gear is moved out of contact with the second gear to prevent rotation of the first gear to transfer to the second gear.

14. The toy launcher of claim 13, wherein:

the at least one flywheel comprises a first flywheel and a second flywheel;

the first flywheel is engaged with the second gear to rotate with the rotation of the second gear; and the launch mechanism further comprises a flywheel reversal gear engaged with the second gear and the second flywheel to transfer rotation from the second gear to the second flywheel and rotate the second flywheel in a direction opposite to the rotation of the first flywheel.

15. The toy launcher of claim 14, further comprising a flywheel connecting rod that includes a first end and an opposite second end, the first end being rotatably coupled to the first flywheel and the second end being rotatably coupled to the second flywheel, wherein the flywheel connecting rod maintains a predetermined distance of separation between the first flywheel and the second flywheel.

16. The toy launcher of claim 12, wherein the trigger mechanism further comprises:

a pair of side shields positioned on opposing sides of the trigger, the pair of side shields being pivotally coupled to the trigger.

17. The toy launcher of claim 12, wherein:

the housing further comprises a first gear plate including a protrusion, a bore formed in the protrusion, and a groove extending along the protrusion, the trigger mechanism further comprises a roller positioned in the bore of the first gear plate, and the trigger bar extends into the groove to contact and be movable along the roller.

18. The toy launcher of claim 12, wherein the housing further comprises an access opening and an access door pivotally coupled to the housing and is configured to be extend across the access opening.

* * * * *